US008147346B2

(12) United States Patent
Long

(10) Patent No.: US 8,147,346 B2
(45) **Date of Patent: *Apr. 3, 2012**

(54) SYSTEM FOR IMPROVED GOLF FLAG STICK STABILITY AND REDUCED GOLF CUP AND/OR FLAG STICK FERRULE WEAR

(76) Inventor: Michael J. Long, Graham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/636,694

(22) Filed: Dec. 11, 2009

(65) Prior Publication Data

US 2011/0086719 A1 Apr. 14, 2011

Related U.S. Application Data

(60) Provisional application No. 61/250,467, filed on Oct. 9, 2009.

(51) Int. Cl.
*A63B 57/00* (2006.01)

(52) U.S. Cl. ..... 473/176

(58) Field of Classification Search ..... 473/173–178; 116/173; 248/545

See application file for complete search history.

(56) References Cited

U.S. PATENT DOCUMENTS

| | | | | |
|---|---|---|---|---|
| 1,329,732 A | | 2/1920 | Verity | |
| 1,505,375 A | * | 8/1924 | Chenoweth | 473/176 |
| 1,675,089 A | | 6/1928 | Bloom | |
| 1,676,954 A | * | 7/1928 | Kannemann | 473/176 |
| 1,813,696 A | | 7/1931 | Crocker | |
| 1,829,283 A | * | 10/1931 | Kip | 473/177 |
| 1,918,994 A | | 7/1933 | Stutz | |
| 1,943,610 A | | 1/1934 | John | |
| 2,929,628 A | * | 3/1960 | Lane | 473/176 |
| 3,310,026 A | * | 3/1967 | Baird, Jr. | 116/173 |
| 3,348,797 A | * | 10/1967 | Turbyfill | 248/539 |
| 3,436,077 A | | 4/1969 | Geram | |
| 3,572,707 A | | 3/1971 | Stapleton, Jr | |
| 4,095,788 A | * | 6/1978 | Benenson | 473/176 |

(Continued)

FOREIGN PATENT DOCUMENTS

WO WO 2008/147581 A1 12/2008

OTHER PUBLICATIONS

Commonly-assigned, co-pending Design U.S. Appl. No. 29/360,200 for "Golf Cup and Flag Stick," (Unpublished, filed Apr. 21, 2010).

(Continued)

*Primary Examiner* — Mark Graham
(74) *Attorney, Agent, or Firm* — Jenkins, Wilson, Taylor & Hunt, P.A.

(57) ABSTRACT

The subject matter described herein includes a system for improved golf flag stick stability and reduced golf cup and/or flag stick ferrule wear. The system includes a ferrule locatable on an end of a golf flag stick that is inserted in a golf cup. The ferrule has a top portion, a bottom portion, and a sidewall located between the top portion and the bottom portion, where the sidewall tapers inward at an angle selected from the range of 5 degrees to 30 degrees from the top portion to the bottom portion. The system further includes a golf cup having a central aperture for receiving the flag stick. The central aperture is defined by a sidewall that is tapered inward at an angle corresponding to an angle of the ferrule.

7 Claims, 3 Drawing Sheets

U.S. PATENT DOCUMENTS

| | | | | |
|---|---|---|---|---|
| 4,114,879 | A | 9/1978 | Oiler | |
| 5,451,045 | A | 9/1995 | Garske | |
| 5,964,667 | A | 10/1999 | Brookman | |
| 6,345,722 | B1 | 2/2002 | Wingate | |
| 6,722,997 | B2 * | 4/2004 | Gilmour | 473/176 |
| 6,939,239 | B1 | 9/2005 | Ash | |
| 7,033,280 | B2 * | 4/2006 | Hottle et al. | 473/176 |
| 7,455,594 | B1 | 11/2008 | Priegel | |
| 7,497,053 | B2 * | 3/2009 | Nicolet | 52/161 |
| 7,500,919 | B2 | 3/2009 | Priegel | |
| 7,594,859 | B2 | 9/2009 | Mullen | |
| D642,958 | S | 8/2011 | Long | |
| 2003/0096659 | A1 | 5/2003 | Webb | |
| 2003/0157989 | A1 | 8/2003 | Porter | |
| 2009/0137331 | A1 | 5/2009 | Hansen | |
| 2010/0004068 | A1 | 1/2010 | Adame | |

OTHER PUBLICATIONS

Notice of Allowance and Fee(s) Due for Design U.S. Appl. No. 29/360,200 (Feb. 2, 2011).

* cited by examiner

SYSTEM FOR IMPROVED GOLF FLAG STICK STABILITY AND REDUCED GOLF CUP AND/OR FLAG STICK FERRULE WEAR

PRIORITY CLAIM

This application claims the benefit of U.S. Provisional Patent Application Ser. No. 61/250,467, filed Oct. 9, 2009; the disclosure of which is incorporated herein by reference in its entirety.

TECHNICAL FIELD

The subject matter described herein relates to golf cups and flag sticks. More particularly, the subject matter described herein relates to a system for improved golf flag stick stability and reduced golf cup and/or flag stick ferrule wear. As well, the subject matter described herein relates to providing more consistent golf ball entry due to the stabilization of the flag stick.

BACKGROUND

Golf cups typically comprise cylinders with central cylindrical holes or bores for receiving golf flag sticks. A problem with this design is that the flag stick end, which often includes a ferrule, and/or the central bore in the golf cup that receives the flag stick is subject to excessive wear. For example, frictional wear caused by movement between the ferrule and the flag stick bore caused by wind, repeated insertion and removal of the flag stick, and gravity, can make the fit between the ferrule and the golf cup bore degrade over time. As a result, the golf flag stick will not sit vertically in the golf cup and the entire assembly must be periodically replaced. Periodic replacement of the cups and flag sticks increases the cost of golf course maintenance.

Accordingly, in light of these difficulties, there exists a long felt need for system for improved golf flag stick stability and reduced golf cup and/or flag stick ferrule wear.

SUMMARY

The subject matter described herein includes a system for improved golf flag stick stability and reduced golf cup and/or flag stick ferrule wear. The system includes a ferrule locatable on an end of a golf flag stick that is inserted in a golf cup. The ferrule has a top portion, a bottom portion, and a sidewall located between the top portion and the bottom portion, where the sidewall tapers inward at an angle selected from the range of 5 degrees to 30 degrees from the top portion to the bottom portion. The system further includes a golf cup having a central aperture for receiving the flag stick. The central aperture is defined by a sidewall that is tapered inward at an angle corresponding to an angle of the ferrule.

BRIEF DESCRIPTION OF THE DRAWINGS

Preferred embodiments of the subject matter described herein will now be explained with reference to the accompanying drawings of which.

DETAILED DESCRIPTION

Figure 1:
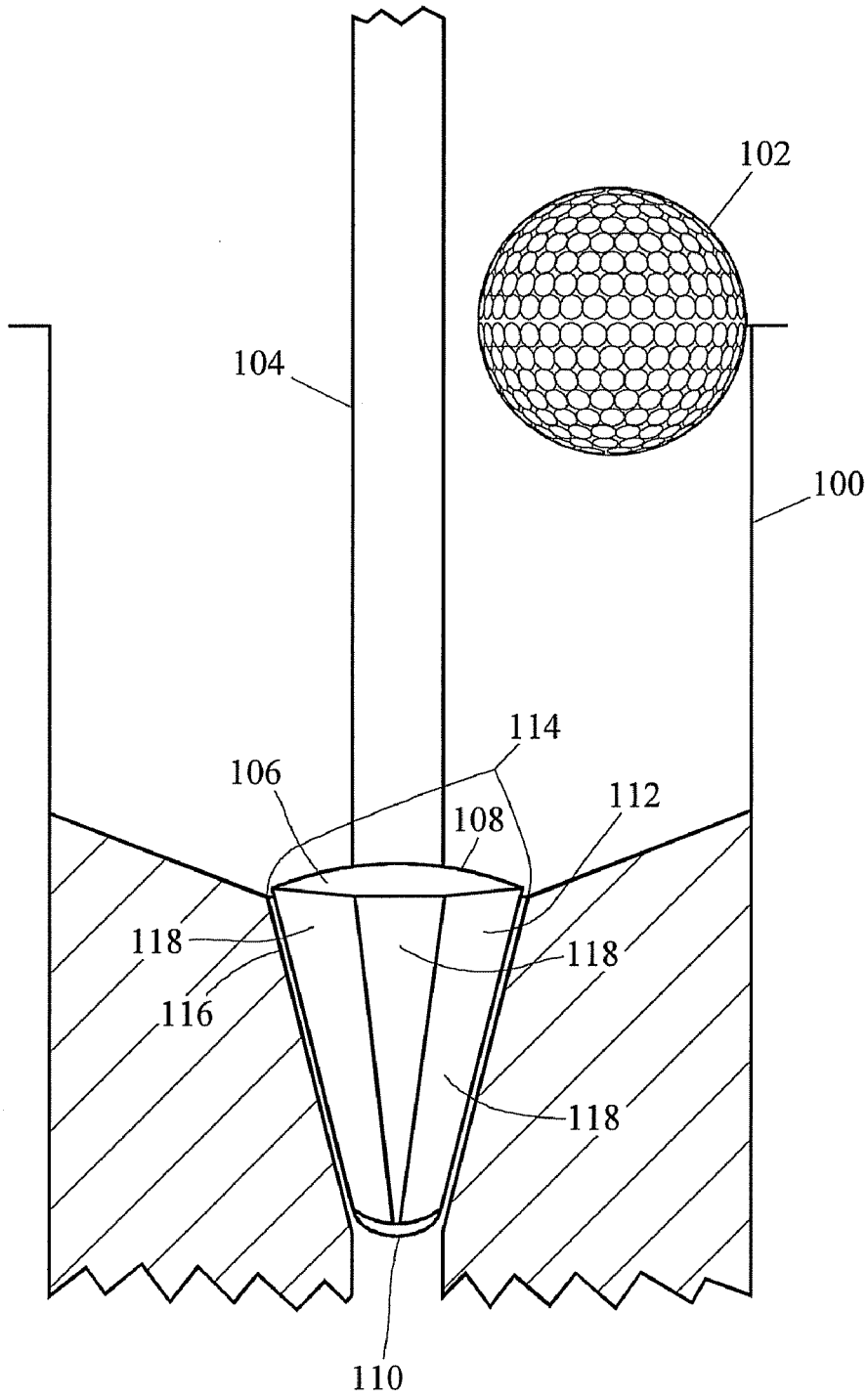
FIG. 1 is a sectional view of a golf cup and a side view of a flag stick and ferrule according to an embodiment of the subject matter described herein.

The subject matter described herein includes a system for improved golf flag stick stability and reduce golf cup and/or flag stick ferrule wear. FIG. 1 is a sectional view of such a system including a golf cup and a flag stick ferrule according to an embodiment of the subject matter described herein. Referring to FIG. 1, a golf cup 100 comprises a generally cylindrical member insertable in a putting green on a golf course for receiving golf balls, such as golf ball 102. A flag stick 104 is insertable into golf cup 100 for alerting golfers as to the position of golf cup 100. Flag stick 104 includes a ferrule 106 located on the end of the flag stick that is insertable in to golf cup 100. Ferrule 106 includes a top portion 108, a bottom portion 110, and a sidewall 112.

To reduce wear between sidewall 112 and the corresponding surface of an aperture 114 of golf cup 100, sidewall 112 tapers inward at an angle selected from a range of between about 5 degrees and about 30 degrees from top portion 106 to bottom portion 110. In the illustrated example, the taper angle is 12 degrees.

In order to further promote flag stick stability and reduced wear between ferrule 106 and aperture 114, aperture 114 also includes a sidewall 116 that tapers inward at an angle corresponding to the angle of ferrule 106. As such, the taper angle of sidewall 116 may range from 5 degrees to 30 degrees. In the illustrated example, the taper angle of sidewall 116 is 12 degrees.

Figure 2:
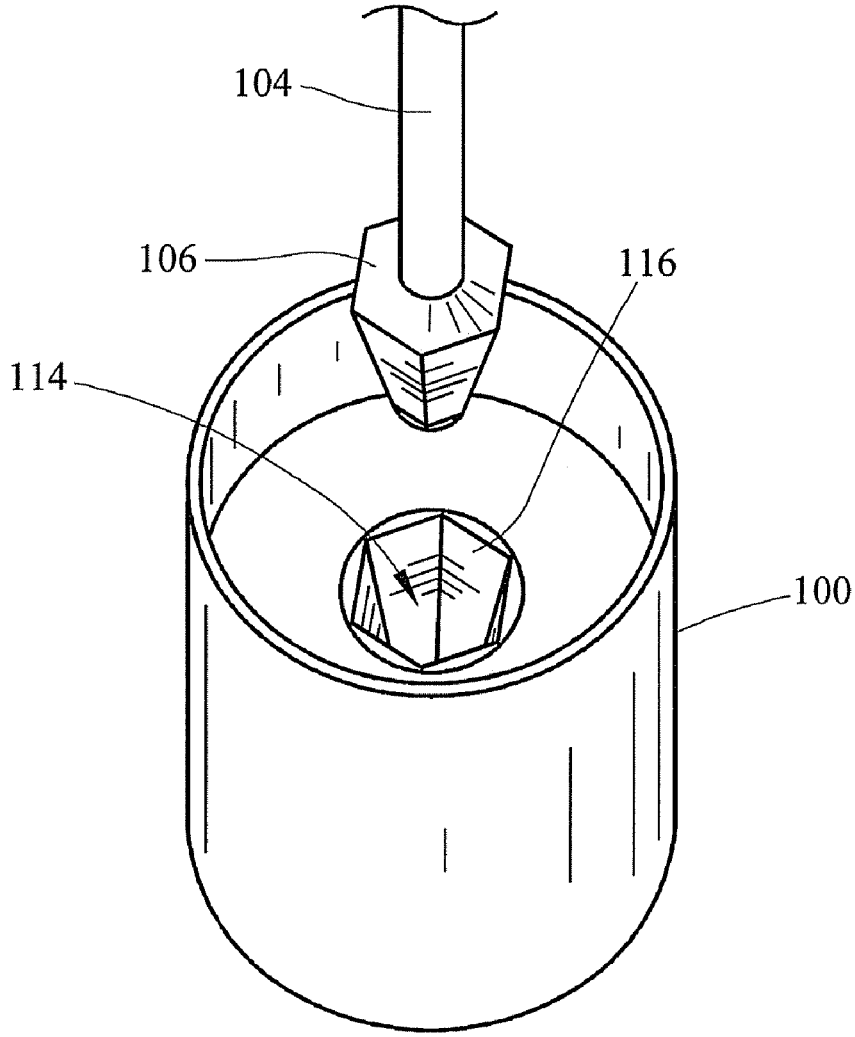
FIG. 2 is a perspective view of a golf cup, a flag stick, and a ferrule according to an embodiment of the subject matter described herein.

In the illustrated example, sidewall 112 is multifaceted. That is, sidewall 112 may have a number of sides or faces 118 that reduce the likelihood of rotational movement of flag stick 104. The number of sides or faces may range from one side or face in an inverted conical design to any number of faces or sides to form an inverted n-sided pyramid structure, where n is an integer of at least 3. In the illustrated example, three faces 118 are shown, where each face has a substantially triangular shape. The remaining three faces are not visible in FIG. 1. Thus, in FIG. 1, ferrule has a six-sided top portion 108 and triangular sidewalls 118, forming an inverted hexagonal pyramid structure. It can be seen from FIG. 2 that the number of faces of central aperture 114 corresponds to the number of faces of the tapered portion of ferrule 106.

According to another aspect of the subject matter described herein, ferrule 106 has a lipless design. That is, top portion 108 does not include a lip that extends over the bottom surface of golf cup 100.

Figure 3:
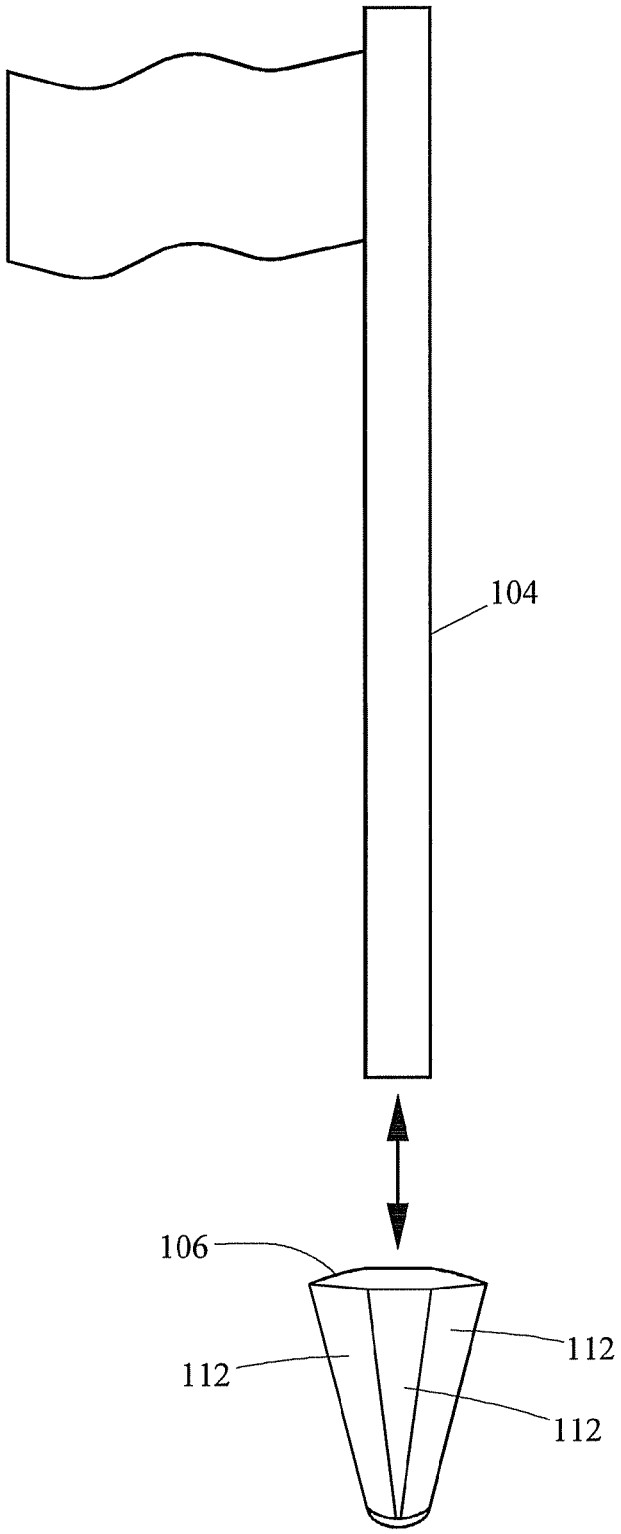
FIG. 3 is a side view of a flag stick with a detachable ferrule according to an embodiment of the subject matter described herein.

In one example, as illustrated in FIG. 3, ferrule 106 may be detachably insertable onto existing flag stick ends. That is, ferrule 106 may be sold as a detachable flag stick attachment along with corresponding golf cup designs. In an alternate embodiment, flag stick 104 and ferrule 106 may be integrally formed and sold as an integral unit.

Accordingly, by providing a flag stick ferrule and golf cup design as illustrated in FIG. 1, improved flag stick stability and reduced golf cup and/or flag stick ferrule wear are provided.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A system for improved golf flag stick stability and reduced golf cup and/or flag stick ferrule wear, the system comprising:

a ferrule locatable on an end of a golf flag stick that is insertable in a golf hole, the ferrule having a top portion, a bottom portion, and a plurality of sidewalls, wherein the each of the sidewalls tapers inward at an angle in the range of 5 degrees to 30 degrees from the top portion to the bottom portion; and a golf cup having a central aperture for receiving the flag stick ferrule, the central aperture being defined by a plurality of sidewalls that taper inward at an angle substantially corresponding to the angle of the sidewalls of the flag stick ferrule, wherein, when the ferrule is inserted in the central aperture, the sidewalls of the ferrule directly contact the sidewalls of the central aperture over a substantial portion of the surface of each sidewall of the ferrule extending from the top portion of the ferrule to the bottom portion of the ferrule.

2. The system of claim 1 wherein the taper of the ferrule sidewall is about 12 degrees.

3. The system of claim 1 wherein the ferrule is multifaceted and the central aperture is also multifaceted.

4. The system of claim 3 wherein the ferrule comprises an inverted n-sided pyramid structure, n being an integer of at least 3.

5. The system of claim 1 wherein the top portion of the ferrule is lipless.

6. The system of claim 1 wherein the ferrule is detachably couplable to the end of the golf flag stick.

7. The system of claim 1 wherein the ferrule is integrally formed with the end of the golf flag stick.

* * * * *